US006807708B2

(12) United States Patent
Roney et al.

(10) Patent No.: US 6,807,708 B2
(45) Date of Patent: Oct. 26, 2004

(54) UPRIGHT VACUUM CLEANER WITH DUAL HOSES AND HOSE PORTS

(75) Inventors: Jeffrey T. Roney, Stanford, KY (US); Danielle M. Hafling, Lancaster, KY (US)

(73) Assignee: Matsushita Electric Corporation of America, Secaucus, NJ (US)

( * ) Notice: Subject to any disclaimer, the term of this patent is extended or adjusted under 35 U.S.C. 154(b) by 311 days.

(21) Appl. No.: 10/097,995

(22) Filed: Mar. 14, 2002

(65) Prior Publication Data

US 2002/0129460 A1 Sep. 19, 2002

Related U.S. Application Data

(60) Provisional application No. 60/275,842, filed on Mar. 14, 2001.

(51) Int. Cl.[7] ..... A47L 9/10; A47L 9/14

(52) U.S. Cl. ..... 15/351; 15/339; 15/352; 15/384

(58) Field of Search ..... 15/331, 334, 339, 15/347, 350–352, 383, 384; 55/DIG. 3

(56) References Cited

U.S. PATENT DOCUMENTS

| | | | | | |
|---|---|---|---|---|---|
| 869,542 | A | | 10/1907 | Bergens | |
| 1,601,774 | A | | 10/1926 | Scheffer | |
| 1,795,533 | A | | 3/1931 | Wright | |
| 2,613,242 | A | * | 10/1952 | Shumaker et al. | 310/258 |
| 2,618,007 | A | | 11/1952 | Fuller | |
| 2,633,597 | A | * | 4/1953 | Turner | 15/383 |
| 3,082,466 | A | | 3/1963 | Tucker et al. | |
| D213,066 | S | | 12/1968 | Wright | |
| D258,211 | S | | 2/1981 | St. Martin | |
| 4,262,384 | A | * | 4/1981 | Bowers | 15/328 |
| 4,392,271 | A | * | 7/1983 | Sepke | 15/339 |
| 4,939,808 | A | | 7/1990 | Roden et al. | |
| 5,005,253 | A | | 4/1991 | Noelle et al. | |
| 5,018,240 | A | * | 5/1991 | Holman | 15/349 |
| 5,077,862 | A | | 1/1992 | Rench | |
| 5,101,532 | A | * | 4/1992 | Dyson et al. | 15/320 |
| 5,123,141 | A | | 6/1992 | Erickson et al. | |
| 5,718,016 | A | | 2/1998 | Sung | |
| 5,819,368 | A | * | 10/1998 | Wang et al. | 15/339 |
| 5,946,771 | A | | 9/1999 | Bosyj et al. | |
| 6,256,832 | B1 | * | 7/2001 | Dyson | 15/324 |
| 6,289,552 | B1 | * | 9/2001 | McCormick | 15/324 |
| 6,574,827 | B2 | * | 6/2003 | Hashizume et al. | 15/339 |
| 2001/0054355 | A1 | * | 12/2001 | Embree et al. | 95/273 |
| 2002/0124346 | A1 | * | 9/2002 | Steiner et al. | 15/384 |
| 2003/0131442 | A1 | * | 7/2003 | Palobeis et al. | 15/412 |

FOREIGN PATENT DOCUMENTS

| | | | |
|---|---|---|---|
| DE | 4035411 A | | 5/1992 |
| WO | WO 03/039319 | * | 11/2002 |

* cited by examiner

*Primary Examiner*—Terrence R. Till
(74) *Attorney, Agent, or Firm*—King & Schickli, PLLC

(57) ABSTRACT

An upright vacuum cleaner includes a nozzle assembly having a nozzle cavity and a canister assembly pivotally connected to the nozzle assembly. A dust bag is carried by the canister assembly. A dirty air pathway provides fluid communication between the nozzle cavity and dust bag. A suction generator generates a vacuum for drawing dirt and debris from the nozzle cavity, through the dirty air pathway to the dust bag. The dirty air pathway includes dual suction ports carried on the nozzle assembly in fluid communication with the nozzle cavity, a splitter carried on the canister assembly, dual suction hoses in fluid communication between the dual suction ports and the splitter, a removable bag mount carried on the canister assembly and a feed conduit on the canister assembly which provides fluid communication between the splitter and the removable bag mount.

16 Claims, 4 Drawing Sheets

28
10
26
34
29
36
95
40
94
96
62
62
22
38
12
56
54
20
18

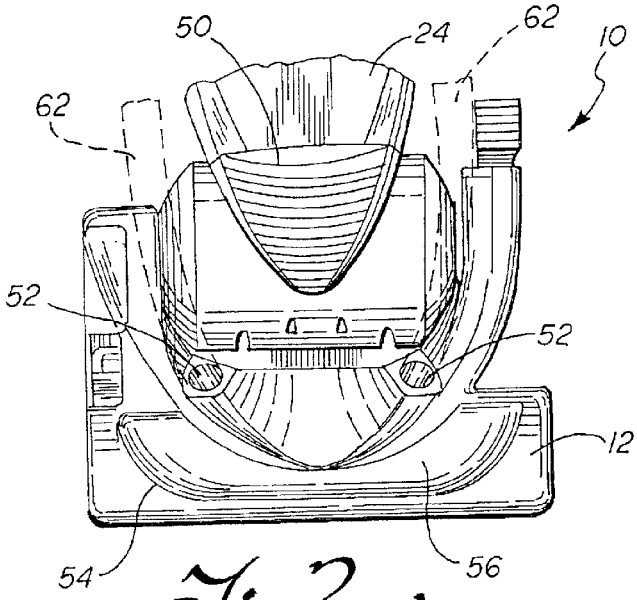
Fig. 2
Fig. 3
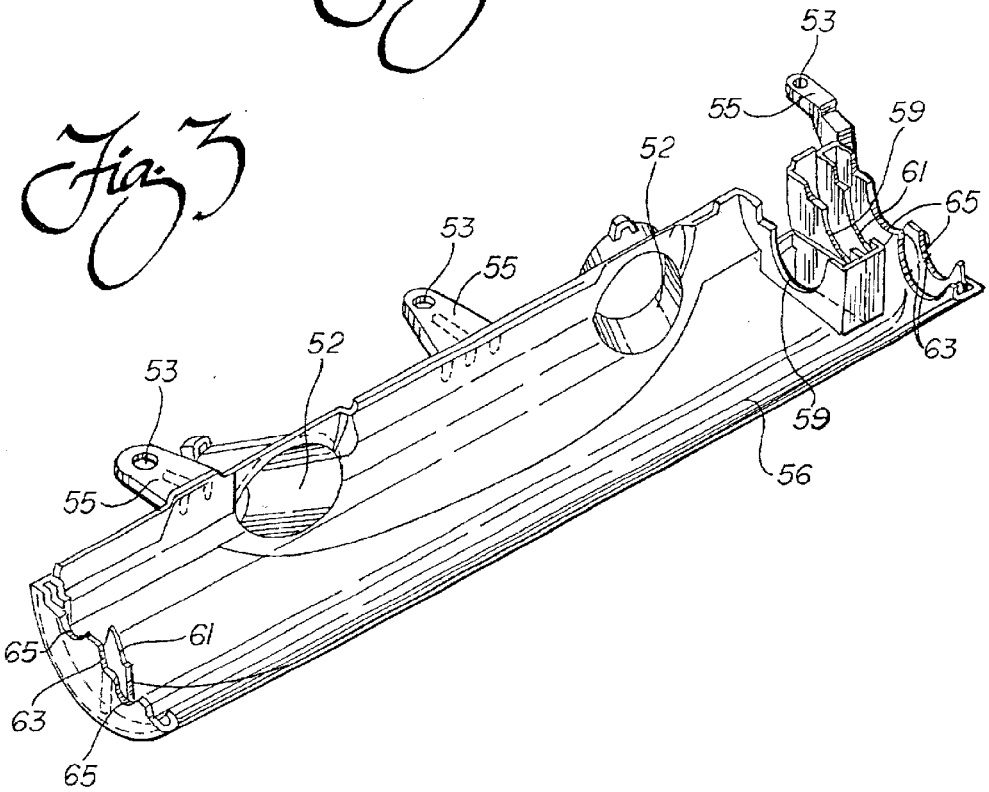

UPRIGHT VACUUM CLEANER WITH DUAL HOSES AND HOSE PORTS

This application claims the benefit of U.S. Provisional Patent Application No. 60/275,842, filed Mar. 14, 2001.

TECHNICAL FIELD

The present invention relates generally to the vacuum cleaner field and, more particularly, to an upright vacuum cleaner incorporating a dual hose and dual hose port air path.

BACKGROUND OF THE INVENTION

Upright vacuum cleaners in all of their designs and permutations have become increasingly popular over the years. The upright vacuum cleaners generally incorporate a nozzle assembly which rides on wheels over the floor surface to be cleaned. A canister assembly is pivotally mounted to the nozzle assembly. The canister assembly includes an operating handle that is manipulated by the user to move the vacuum cleaner back and forth across the floor. The canister assembly also includes either a bag-like filter or a cyclonic separation chamber and filter combination that traps dirt and debris while substantially clean air is exhausted by a fan that is driven by an onboard electric motor. It is this fan and motor arrangement that generates the drop in air pressure necessary to provide the desired cleaning action. In most upright vacuum cleaners sold today, a rotary agitator is also provided in the nozzle assembly. The rotary agitator includes tufts of bristles, brushes, beater bars or the like to beat dirt and debris from the nap of a carpet being cleaned while the pressure drop or vacuum is used to force air entrained with this dirt and debris into the nozzle of the vacuum cleaner.

The present invention relates to an upright vacuum cleaner with a novel airflow pathway incorporating a dual hose and dual hose port construction as well as a removable bag mount which allows simple and convenient cleaning in the event of a clog or other form of air pathway obstruction.

SUMMARY OF THE INVENTION

In accordance with the purposes of the present invention as described herein, an improved upright vacuum cleaner is provided. That upright vacuum cleaner includes (a) a nozzle assembly having a nozzle cavity and (b) a canister assembly pivotally connected to the nozzle assembly. A dust bag is carried by the canister assembly. A dirty air pathway provides fluid communication between the nozzle cavity and the dust bag. A suction generator generates a vacuum for drawing dirt and debris from the nozzle cavity, through the dirty air pathway to the dust bag. The suction generator is carried on either the nozzle assembly or the canister assembly, depending on the particular preference of the vacuum cleaner manufacturer.

The dirty air pathway includes dual suction ports carried on the nozzle assembly that are in fluid communication with the nozzle cavity. A splitter is carried on the canister assembly. Dual suction hoses are provided in fluid communication between the dual suction ports and the splitter.

A removable bag mount is carried on the canister assembly. The bag mount includes an outlet for feeding dirty air from the dirty air pathway into the dust bag. Additionally, a feed conduit is provided on the canister. This feed conduit provides fluid communication between the splitter and the removable bag mount.

In accordance with additional aspects of the present invention, an extension hose port is carried on the canister assembly in the dirty air pathway between the splitter and the removable bag mount. An extension hose for a cleaning tool may be plugged into this port. When plugged into the port, the hose interrupts the vacuum flow to the nozzle assembly and nozzle cavity. The cleaning suction is then directed through the extension hose to the tool on the end of the extension hose to allow manual cleaning with that tool.

Still further, the dual suction hoses may be formed from transparent plastic material. Advantageously, the flexible hoses and transparent material function together to aid the operator in locating and cleaning any clog or other obstruction that might close the air pathway. The hoses may, in fact, be disconnected at both of their ends and as such, may be entirely removed for cleaning if and when desired.

As a further aid in visually locating any clog or obstruction, the nozzle assembly includes a transparent shield which defines a viewing window for the nozzle cavity. Thus, any object that causes an agitator jam may be quickly and easily spotted. Since the dual suction ports are formed as an integral part of the transparent shield, the suction ports may also be visually inspected. Of course, the removal of the dual hoses from the ports allows one to easily access the ports and the lumen of the hoses for cleaning in the event cleaning becomes necessary.

In accordance with yet another aspect of the present invention, the removable bag mount includes a pipe, a mounting flange and a fastener for securing the removable bag mount to the canister assembly. Once removed the bag mount may be easily cleaned. Further, the upper end of the feed conduit carried by the canister assembly may be easily accessed and cleaned following removal of the bag mount. Similarly, the lower end of the feed conduit may be easily cleaned through the door of the extension hose port or by disconnecting the hoses leading to the splitter so as to provide ready access.

In accordance with still another aspect of the present invention, the upright vacuum cleaner may be defined as including a nozzle assembly having a nozzle cavity and a view port to the nozzle cavity. A canister assembly is pivotally connected to the nozzle assembly. A dust bag is carried by the canister assembly. A suction generator for generating a vacuum that draws dirt and debris from the nozzle cavity to the dust bag is carried on the nozzle assembly or the canister assembly. Further, the upright vacuum cleaner is characterized by a transparent shield that forms a window closing the view port. The shield further includes a pair of suction ports for drawing dirt and debris from the nozzle cavity at spaced locations.

This shield is molded from a single piece of transparent plastic material. Further, the shield may also include an integral agitator drive belt guard which functions to keep dirt and debris away from the agitator drive belt during vacuum cleaner operation.

In the following description there is shown and described one possible embodiment of this invention, simply by way of illustration of one of the modes best suited to carry out the invention. As it will be realized, the invention is capable of other different embodiments, and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawing incorporated in and forming a part of the specification, illustrates several aspects of the present invention, and together with the description serves to explain the principles of the invention. In the drawing:

FIG. 2 is a top plan view of the nozzle assembly of that vacuum cleaner showing the orientation of the dual ports;

FIG. 3 is a bottom perspective view of the transparent shield showing the dual ports and the agitator drive belt guard;

Figure 1:
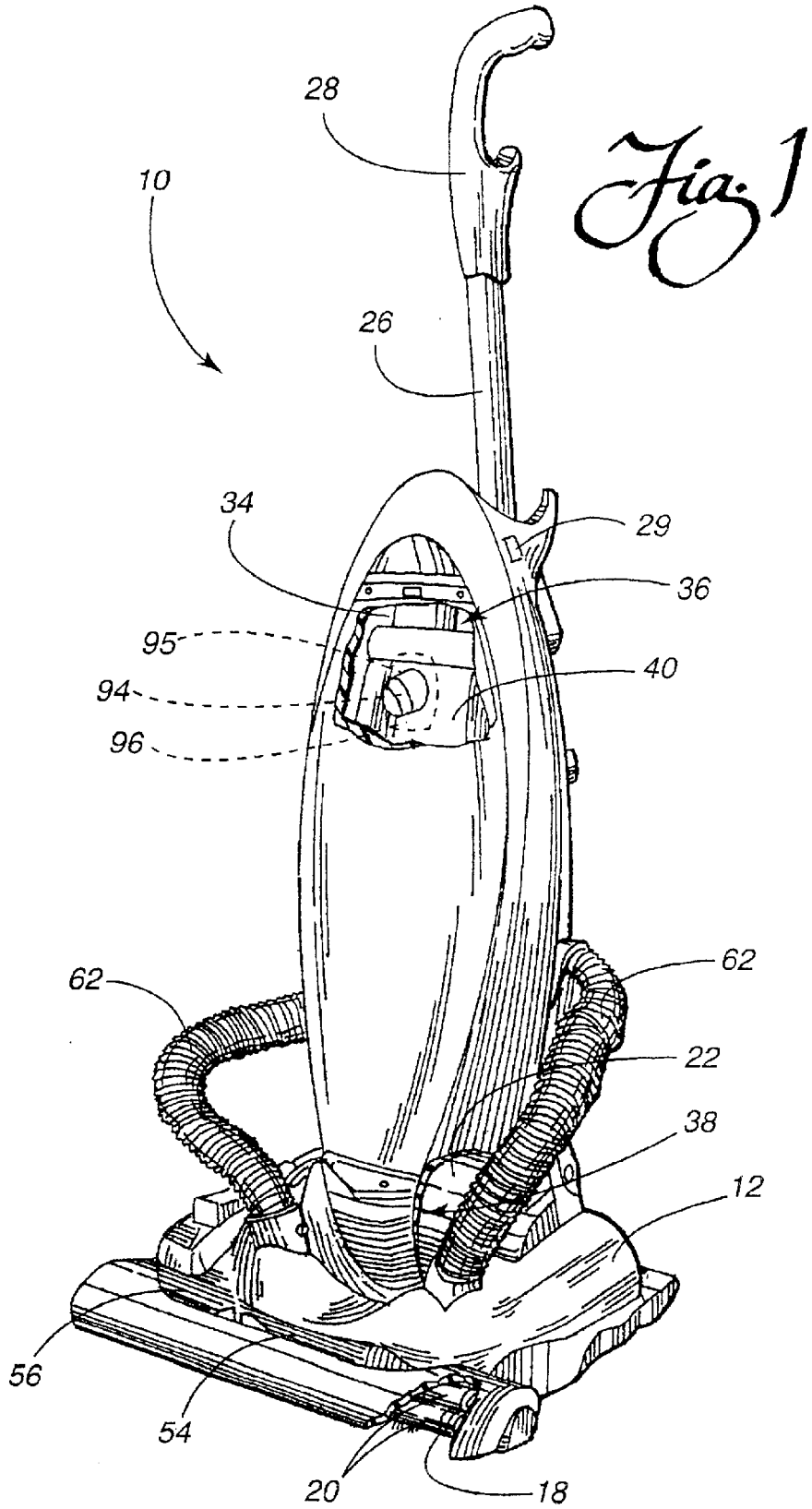
FIG. 1 is a partially broken away, perspective view of an upright vacuum cleaner of the present invention.

Reference will now be made in detail to the present preferred embodiment of the invention, an example of which is illustrated in the accompanying drawing.

DETAILED DESCRIPTION OF THE INVENTION

Reference is now made to the drawing figures showing the upright vacuum cleaner 10 of the present invention. The upright vacuum cleaner 10 includes a nozzle assembly 12 having upper and lower housing sections defining a nozzle cavity 18. One or more rotary agitators 20 (two agitators are illustrated) are mounted for relative rotation on the nozzle assembly 12 in the nozzle cavity 18. The rotary agitators 20 may be driven by a drive motor 22 through means of the drive belt (not shown).

A canister assembly 24 is pivotally connected to the nozzle assembly 12. The canister assembly 24 includes a control handle 26 equipped with a hand grip 28. A control switch 29 is provided for turning the vacuum cleaner on and off. Of course, electrical power is supplied to the vacuum cleaner 10 from a standard electrical wall outlet through an electrical cord (not shown).

A pair of rear wheels 30 (best shown in FIG. 4) are provided at the lower portion of the canister assembly 24 and a second pair of wheels (not shown) are rotatably mounted to the nozzle assembly 12. Together, these wheels support the vacuum cleaner 10 for movement across the floor.

The canister assembly 24 includes a cavity 34 divided into a dust bag compartment 36 and a fan and drive motor compartment 38. A dust bag 40 for collecting dirt and debris is held in the dust bag compartment 36 by a removable bag mount 80. A suction fan and associated drive motor 22 are held in the fan and drive motor compartment 38. This suction fan and drive motor 22 draws air including entrained dirt and debris lifted by the rotating agitators 20 from the nozzle cavity 18 through a dirty air pathway generally designated by reference numeral 44 to the dust bag 40. The dust bag 40 serves to trap the suspended dirt, dust and other particles inside while allowing the now clean air to pass freely into the compartment 36. The cleaned air then is drawn through a secondary filter (not shown) into the fan and drive motor compartment 38. The air passes over the fan and drive motor 22 and is ultimately exhausted through the final filtration cartridge 48 and the exhaust port 50 into the environment.

From the previous general description, it should be appreciated that the dirty air pathway 44 provides fluid communication between the nozzle cavity 18 and the dust bag 40. As best illustrated in FIGS. 1 and 2, the upper housing section of the nozzle assembly 12 includes a view port 54 overlying the nozzle cavity 18. A transparent shield 56 is fastened to the upper housing section by screws or other appropriate fasteners passing through the apertures 53 in the mounting tabs 55 and engaging in bosses (not shown) formed on the nozzle assembly 12. This transparent shield 56 closes the view port 54 and essentially forms a viewing window for observing the operation of the underlying rotary agitators 20. This allows one to visually confirm the proper function and operation of the agitators 20 at all times.

As best shown in FIG. 3, the transparent shield 56 includes dual suction ports 52 and an integral agitator drive belt guard 58. In the embodiment illustrated, the transparent shield 56 including the dual suction ports 52 and the drive belt guard 58 is integrally molded from a single piece of transparent plastic material. Thus, the interior wall of the shield 56, including the dual suction ports 52 is smooth and continuous for efficient, nonturbulent air flow. The drive belt guard 58 protects the drive belt 22 from direct contact with dirt and debris including that which might otherwise become entwined with the belt. More specifically, the drive belt guard 58 includes a pair of aligned arcuate cutouts 59, one in each sidewall thereof, that correspond in size and shape to the hub of the agitators 20. Accordingly, no gap is present to allow the passage of any dirt and debris into the pulley and drive belt area.

As further shown, the transparent shield 56 includes double end walls 61, 63 providing exposed lower edges for mating with the lower section of the nozzle assembly 12. The end walls 61, 63 also include the necessary cutouts 65 to accommodate the ends of the agitators 20. The cutouts 65 are sized and shaped to correspond with the hubs of the two agitators 20. Thus, no gaps are present to allow the passage of dirt and debris into the agitator bearings (not shown) at the end of the agitators 20.

Figure 4:
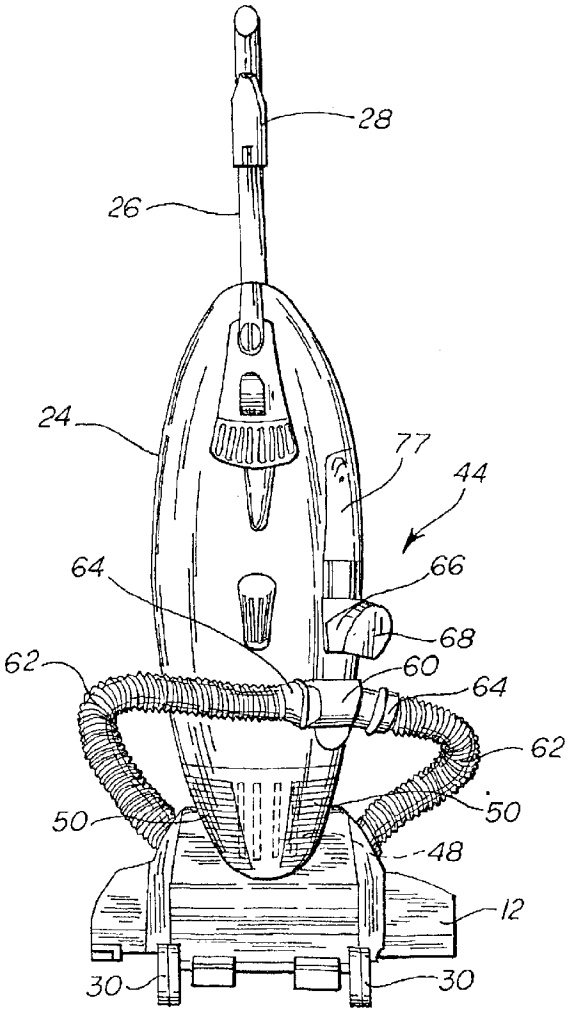
FIG. 4 is a rear elevational view of the upright vacuum cleaner.

As best shown in drawing FIG. 4, a splitter 60 is carried on the canister assembly 24. Dual hoses 62 provide fluid communication between the dual suction ports 52 and the splitter 60. Each of the dual hoses 62 is formed from a flexible, transparent plastic material which may be reinforced with coiled wire or other means. Couplers 64 at the ends of each dual hose 62 allow snug press-on connection between the dual hoses 62 and the cooperating dual suction port 52 at one end and the splitter 60 at the other end.

Figure 6:
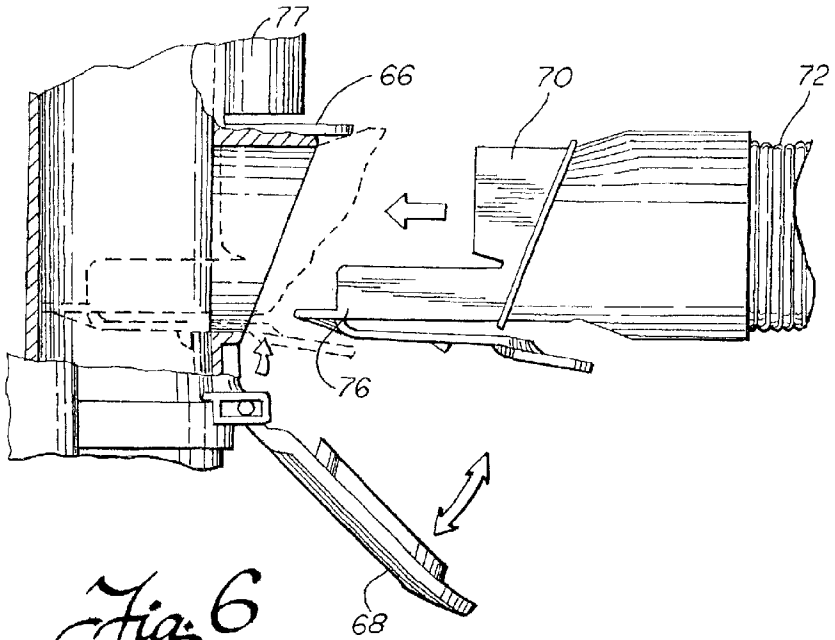
FIG. 6 is a detailed cross-sectional view showing the hose extension port with the extension hose plugged in place in phantom line.

The splitter 60 feeds directly into an extension hose port 66. Extension hose port 66 includes a hinged door 68 which may be opened to receive a cooperating plug 70 on the end of an extension hose 72 (see FIG. 6). The other end of the extension hose 72 may be connected to a work piece or tool such as a brush or nozzle (not shown). The plug 70 includes a projecting lug 76 that when fully inserted in the extension hose port 66, seals the passageway in the port leading to the splitter 60 (note phantom line showing). In this way, the insertion of the plug 70 in the extension hose port 66 routes the vacuum force generated by the suction fan and drive motor 22 wholly through the extension hose 72 to the brush or nozzle for efficient cleaning. The removal of the plug 70 reopens the passageway in the extension hose port 66 to the splitter 60. The closing of the hinged door 68 then restores air flow to the nozzle cavity 18.

The extension hose port 66 is connected to one end of a feed conduit 77 carried on the canister assembly 24. Feed conduit 77 communicates at the opposite end with a port 78 (see FIG. 5) formed in the canister assembly wall. A removable bag mount, generally designated by reference numeral 80, is secured in a mounting box 82 integrally formed or molded on the wall of the canister assembly 24 in the cavity 34.

Figure 5:
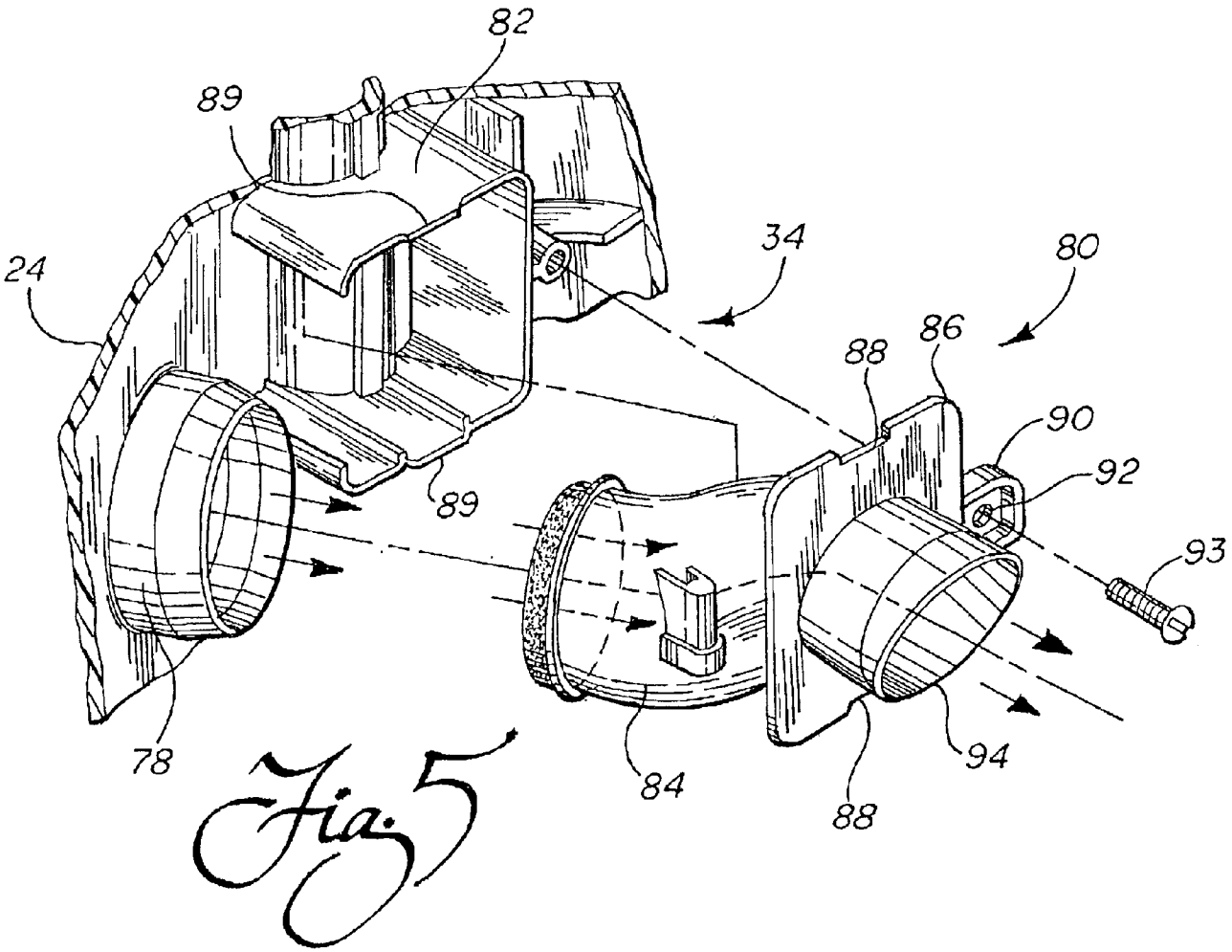
FIG. 5 is a detailed exploded view of the removable bag mount.

As best shown in FIG. 5, bag mount 80 includes a curved pipe 84 for engaging in the port 78, a mounting flange 86 with notches 88 for cooperating engagement with locating tabs 89 carried on the mounting box 82 and a mounting lug 90 with an aperture 92 for receiving a screw fastener 93 which secures the bag mount in position on the canister assembly 24. The projecting end 94 of the curved pipe 84 projects through an opening 95 in a cardboard collar 96 of the dust bag 40.

In operation, the rotating agitators 20 brush and beat dirt and debris from the nap of an underlying carpet upwardly into the nozzle cavity 18. The suction fan and drive motor 22 generates negative air pressure which draws air including the entrained dust, dirt and debris from the nozzle cavity 18 through the dual suction ports 52. As shown, the ports 52 are spaced toward the sides of the nozzle assembly 12 and the nozzle cavity 18 so that a substantially consistent negative pressure is provided across the entire width of the unit to more efficiently draw dirt and debris into the vacuum cleaner 10. The air entrained with dirt and debris passes through the dual suction ports 52 and the dual hoses 62 in fluid communication therewith into the splitter 60. From there the air entrained with dirt and debris is drawn through the extension hose port 66 and the feed conduit 77 through the port 78 into the curved pipe 84 of the bag mount 80. From there the air entrained with dirt and debris is delivered through the end 94 into the dust bag 40. The dust bag 40 traps the dirt and debris but is sufficiently porous to allow the air to be drawn through the wall of the dust bag 40 into the compartment 36. From there the relatively clean air passes through the secondary filter (not shown) into the fan and drive motor compartment 38. The air then is drawn through the fan and is passed over the drive motor 22 to provide cooling. The air then passes through the final filtration cartridge 48 and is exhausted into the environment through the exhaust port 50.

The transparent shield 56 allows the operator to monitor the function of the agitators 20 during operation. Accordingly, it is possible to quickly and conveniently visually confirm the existence of any agitator jam. Any obstruction or clog in the dirty air pathway 44 is also easy to visually locate and eliminate. The transparent ports 52 and hoses 62 allow quick visual inspection. Connection points at both ends of the hoses 62, the access door 68 and the removable bag mount 80 all provide the operator with multiple access points to reach and eliminate obstructions and clogs. In fact, the hoses 62 and the bag mount 80 may be completely removed and cleaned in a sink with soap and water if desired.

The foregoing description of the preferred embodiment of the invention has been presented for purposes of illustration and description. It is not intended to be exhaustive or to limit the invention to the precise form disclosed. Obvious modifications or variations are possible in light of the above teachings.

The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled.

What is claimed is:

1. An upright vacuum cleaner, comprising:

a nozzle assembly including a nozzle cavity;

a canister assembly pivotally connected to said nozzle assembly;

a dust bag carried by said canister assembly;

a dirty air pathway providing fluid communication between said nozzle cavity and said dust bag; and a suction generator for generating a vacuum for drawing dirt and debris from said nozzle cavity, through said dirty air pathway to said dust bag, said suction generator being carried on one of said nozzle assembly and said canister assembly;

said dirty air pathway including;

dual suction ports carried on said nozzle assembly in fluid communication with said nozzle cavity;

a splitter carried on said canister assembly;

dual suction hoses providing fluid communication between said dual suction ports and said splitter;

a removable bag mount carried on said canister assembly including an outlet for feeding dirty air from said dirty air pathway into said dust bag; and a feed conduit on said canister assembly providing fluid communication between said splitter and said removable bag mount.

2. The vacuum cleaner of claim 1, further including an extension hose port in said dirty air pathway.

3. The vacuum cleaner of claim 1, further including an extension hose port carried on said canister assembly in said dirty air pathway between said splitter and said removable bag mount.

4. The vacuum cleaner of claim 1, wherein said dual suction hoses are formed from transparent plastic material.

5. The vacuum cleaner of claim 1, further including an agitator held in said nozzle cavity for rotation with respect to said nozzle assembly.

6. The vacuum cleaner of claim 1, wherein said nozzle assembly includes a transparent shield defining a viewing window for said nozzle cavity and said dual suction ports.

7. The vacuum cleaner of claim 1, wherein said removable bag mount includes a pipe, a mounting flange and a fastener for securing said removable bag mount to said canister assembly.

8. An upright vacuum cleaner, comprising:

a nozzle assembly having a nozzle cavity and a view port to said nozzle cavity;

a canister assembly pivotally connected to said nozzle assembly;

a dust bag carried by said canister assembly;

a suction generator for generating a vacuum that draws dirt and debris from said nozzle cavity to said dust bag;

said upright vacuum cleaner being characterized by a transparent shield that forms a window closing said view port, said shield further including a pair of suction ports for drawing dirt and debris from said nozzle cavity at spaced locations.

9. The vacuum cleaner of claim 8, wherein said shield is molded from a single piece of plastic material.

10. The vacuum cleaner of claim 8, wherein said shield also includes an integral agitator drive belt guard.

11. An upright vacuum cleaner, comprising:

a nozzle assembly having a nozzle cavity;

a canister assembly pivotally connected to said nozzle assembly;

a dust bag carried on said canister assembly;

a suction generator for generating a vacuum that draws dirt and debris from said nozzle cavity to said dust bag; and a dirty air pathway providing fluid communication between said nozzle cavity and said dust bag, said dirty air pathway including dual suction ports in fluid connection with said nozzle cavity and a lone feed conduit in fluid communication with said suction generator.

12. The upright vacuum cleaner of claim 11, wherein said dual suction ports are transparent.

13. An upright vacuum cleaner, comprising:

a nozzle assembly having a nozzle cavity;

a canister assembly pivotally connected to said nozzle assembly;

a removable bag mount fastened to said canister assembly by a releasable fastener;

a dust bag held on said removable bag mount; and a suction generator for generating a vacuum that draws dirt and debris from said nozzle cavity to said dust bag.

14. The upright vacuum cleaner of claim 13, wherein said removable bag mount includes a pipe and a mounting flange.

15. The upright vacuum cleaner of claim 14, wherein said removable bag mount includes at least one notch and said canister assembly includes a mounting box for engaging said mounting flange, said mounting box carrying at least one locating tab for engaging said at least one notch.

16. An upright vacuum cleaner, comprising:

a nozzle assembly including a nozzle cavity;

a canister assembly connected to said nozzle assembly;

a dust bag carried on said upright vacuum cleaner;

a dirty air pathway providing fluid communication between said nozzle cavity and said dust bag; and a suction generator for generating a vacuum for drawing dirt and debris from said nozzle cavity, through said dirty air pathway to said dust bag, said suction generator being carried on one of said nozzle assembly and said canister assembly;

said dirty air pathway including;

dual suction ports in fluid communication with said nozzle cavity;

a splitter;

dual suction hoses providing fluid communication between said dual suction ports and said splitter;

a removable bag mount including an outlet for feeding dirty air from said dirty air pathway into said dust bag; and a feed conduit providing fluid communication between said splitter and said removable bag mount.

* * * * *